US012644372B1

(12) United States Patent
Zhao et al.

(10) Patent No.: US 12,644,372 B1
(45) Date of Patent: Jun. 2, 2026

(54) AUTOMATED CEMENT QUALITY EVALUATION

(71) Applicant: Schlumberger Technology Corporation, Sugar Land, TX (US)

(72) Inventors: Xin Zhao, Beijing (CN); Jiankun Yang, Beijing (CN); Hong Zhi Guo, Beijing (CN); Kamaljeet Singh, Bucharest (RO); Mohamed Aiman Ali Fituri, Bucharest (RO); Thanh Nhan Nguyen, Clamart (FR); Yan Hua Zhang, Beijing (CN); Sheng Huang, Beijing (CN); Hongmei An, Beijing (CN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/211,334

(22) Filed: May 19, 2025

(51) Int. Cl.
*E21B 47/005* (2012.01)

(52) U.S. Cl.
CPC ..... *E21B 47/005* (2020.05)

(58) Field of Classification Search
CPC ..... E21B 47/005
See application file for complete search history.

(56) References Cited

U.S. PATENT DOCUMENTS 10,364,664 B2 * 7/2019 Hori ..... G01V 1/52
12,037,887 B2 * 7/2024 Zhao ..... E21B 47/005
2014/0114892 A1 * 4/2014 Quirein ..... E21B 47/005 706/20
2015/0137987 A1 * 5/2015 Donderici ..... G01V 1/48 340/856.4
2019/0025450 A1 * 1/2019 Teague ..... G01V 5/04
2019/0025455 A1 * 1/2019 Teague ..... G01V 5/04
2019/0113643 A1 * 4/2019 Laronga ..... G01V 1/306
2024/0068354 A1 * 2/2024 Zhao ..... G01V 1/50
2025/0179916 A1 * 6/2025 Padhi ..... G01V 1/50

OTHER PUBLICATIONS

Viggen, E. M. et al., "Automatic interpretation of cement evaluation logs from cased boreholes using supervised deep neural networks", Journal of Petroleum Science and Engineering, Dec. 2020, 17 pages, vol. 195.

* cited by examiner

*Primary Examiner* — Shane Bomar
(74) *Attorney, Agent, or Firm* — Kyle R. Miiller

(57) ABSTRACT

A method for determining and classifying a quality of cement in a wellbore includes receiving input data. The input data is captured by one or more acoustic logging tools in the wellbore. The method also includes generating an image or a curve based upon the input data. The method also includes preprocessing the input data and the image or the curve to produce preprocessed data. The method also includes selecting portions of the preprocessed data for determining and classifying the quality of the cement in the wellbore. The method also includes determining and classifying the quality of the cement in the wellbore based upon the selected portions of the preprocessed data.

19 Claims, 17 Drawing Sheets

| BOND QUALITY | SLG MAP FEATURES (IN ZONE) | NOTE |
|---|---|---|
| HIGH | AVERAGE SOLID% >= 80%, AND NO CHANNEL ACROSS | CHANNEL MEANS: AREA OCCUPIED BY MATERIAL CLASSED AS CONNECTED GAS OR LIQUID IN AZIMUTHAL AND AXIAL |
| MODERATE-HIGH | AVERAGE SOLID% >= 80%, AND CHANNEL ACROSS | ALL THRESHOLD IN THIS TABLE CAN BE SET BY THE USER |
| MODERATE | 60% <= AVERAGE SOLID% < 80% | |
| LOW | AVERAGE SOLID% < 60% | |

| BOND QUALITY | BOND INDEX FEATURES (IN ZONE) | NOTE |
|---|---|---|
| HIGH | AVERAGE BI >= 80% | ALL THRESHOLD IN THIS TABLE CAN BE SET BY THE USER |
| MODERATE | 60% <= AVERAGE BI < 80% | |
| LOW | AVERAGE BI < 60% | |

FIG. 10

Inputs | Zonation | Parameters

| | 1 |
|---|---|
| | |
| Group | |
| Well | TongShen18_AutoEvluation |
| Dataset | ConPr_R01_L004Up_USIT_IBC |
| Zone | **ALL** |
| Top | 10.04102 |
| Bottom | 4675.036 |
| centralizer_number | 1 |
| centralizer_number Unit | unitless |
| × xxxx xxpoint_paint | Yes |
| ar_detect | Yes |
| t_good threshold | 90 |
| t_good threshold Unit | % |
| ance | 10 |
| ance Unit | m |
| good threshold | 80 |
| s_medium good threshold Unit | % |
| g_min_dry | 5 |
| g_min_dry Unit | % |
| min_interval | 2 |
| min_interval Unit | m |
| s_medium_bad_threshold_dry | 20 |
| s_medium_bad_threshold_dry Unit | % |
| big_channeling_min_len | 1 |
| big channeling_min_len Unit | m |
| big_channeling_min_wid | 20 |
| big channeling_min_wid Unit | % |
| s_medium_bad_threshold | 50 |
| s_medium_bad_threshold Unit | % |
| outputZonationName | paint_2_0 |

FIG. 12A

AUTOMATED CEMENT QUALITY EVALUATION

BACKGROUND

Cementing is an operation in drilling and completions that helps to isolate permeable zones, provide mechanical support, and protect tubulars from corrosion. The cementing quality directly impacts the wellbore stability. More particularly, poor cementing may lead to structural failure, environmental damage, and repair costs. Therefore, it is helpful to accurately evaluate the cementing quality so the well integrity and operational efficiency can be ensured.

One of the conventional cement quality evaluation methods involves a logging technique. This technique includes running logging tools into the well and collecting data related to the cement status, which can be converted to visual representations. This (e.g., visual) data is then inspected by an expert who assesses the cement bonding visually, providing qualitative estimates of the cement quality. Manual interpretation of these images is labor-intensive and error-prone, leading to inconsistent results. Another challenge is that there are multiple sonic and ultrasonic logging tools, which are based on different physics mechanisms. The data acquired by these different tools may vary. There is no comprehensive workflow or standard to cover these different types of tools. This leads to inefficiency and the potential for errors.

Therefore, what is needed is an improved system and method for automatically evaluating cement quality in a wellbore.

SUMMARY

The present disclosure presents an improved system and method for automatically evaluating cement quality in wellbores. It incorporates a set of algorithms designed to preprocess data collected from various logging tools and automatically interprets this data based upon different physical principles, thereby providing a comprehensive assessment of the cement quality. Compared to conventional manual evaluation methods, this method enhances efficiency and consistency. The algorithms are driven by domain-specific evaluation standards and simulate human logic to ensure stable and reliable results. As a collection of algorithms, this method may be packaged as a portable computing engine, allowing developers to select suitable algorithm modules based on specific application scenarios and deploy them into any application to support automated cement quality evaluation. The method expedites cement quality interpretation work, improves result consistency, and delivers comprehensive and integrated interpretation results.

A method for determining and classifying a quality of cement in a wellbore is disclosed. The method includes receiving input data. The input data is captured by one or more acoustic logging tools in the wellbore. The method also includes generating an image or a curve based upon the input data. The method also includes preprocessing the input data and the image or the curve to produce preprocessed data. The method also includes selecting portions of the preprocessed data for determining and classifying the quality of the cement in the wellbore. The method also includes determining and classifying the quality of the cement in the wellbore based upon the selected portions of the preprocessed data.

A computing system is also disclosed. The computing system includes one or more processors and a memory system. The memory system includes one or more non-transitory computer-readable media storing instructions that, when executed by at least one of the one or more processors, cause the computing system to perform operations. The operations include receiving input data. The input data is captured by one or more logging tools in a wellbore. The one or more logging tools include one or more acoustic logging tools. The one or more acoustic logging tools include a sonic logging tool and/or an ultrasonic logging tool. The ultrasonic logging tool includes an isolation scanner tool and/or an ultrasonic transmitter tool. The input data includes a plurality of measurements including acoustic impedance measurements, flexural attenuation measurements, sonic wave amplitude measurements, and/or casing collar locator measurements. The operations also include generating an image or a curve based upon the input data. The image or the curve includes (1) a solid-liquid-gas (SLG) image that is based upon the acoustic impedance measurements and/or the flexural attenuation measurements, (2) a micro-debonding image that is based upon the acoustic impedance measurements, and/or (3) a bond index (BI) curve that is based upon the sonic wave amplitude measurements. The operations also include preprocessing the input data and the image or the curve to produce preprocessed data. The preprocessed data includes a modified SLG image, a modified micro-debonding image, and/or a modified BI curve. The operations also include selecting portions of the preprocessed data for determining and classifying a quality of cement in the wellbore. The selected portions include (1) the modified SLG image in response to at least a portion of the input data being captured by the isolation scanner tool, (2) the modified micro-debonding image in response to at least a portion of the input data being captured by the ultrasonic transmitter tool, and/or (3) the modified BI curve in response to at least a portion of the input data being captured by the sonic logging tool. The operations also include determining and classifying the quality of the cement in the wellbore based upon the selected portions of the preprocessed data.

It will be appreciated that this summary is intended merely to introduce some aspects of the present methods, systems, and media, which are more fully described and/or claimed below. Accordingly, this summary is not intended to be limiting.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures:

FIG. 10 illustrates a table showing built-in cement quality evaluation criteria (e.g., based on an SLG map and CBL), according to an embodiment.

FIGS. 12A and 12B illustrate an application interface, according to an embodiment.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the present disclosure. The first object or step, and the second object or step, are both, objects or steps, respectively, but they are not to be considered the same object or step.

The terminology used in the description herein is for the purpose of describing particular embodiments and is not intended to be limiting. As used in this description and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques, and workflows that are in accordance with some embodiments. Some operations in the processing procedures, methods, techniques, and workflows disclosed herein may be combined and/or the order of some operations may be changed.

System Overview

Figure 1:
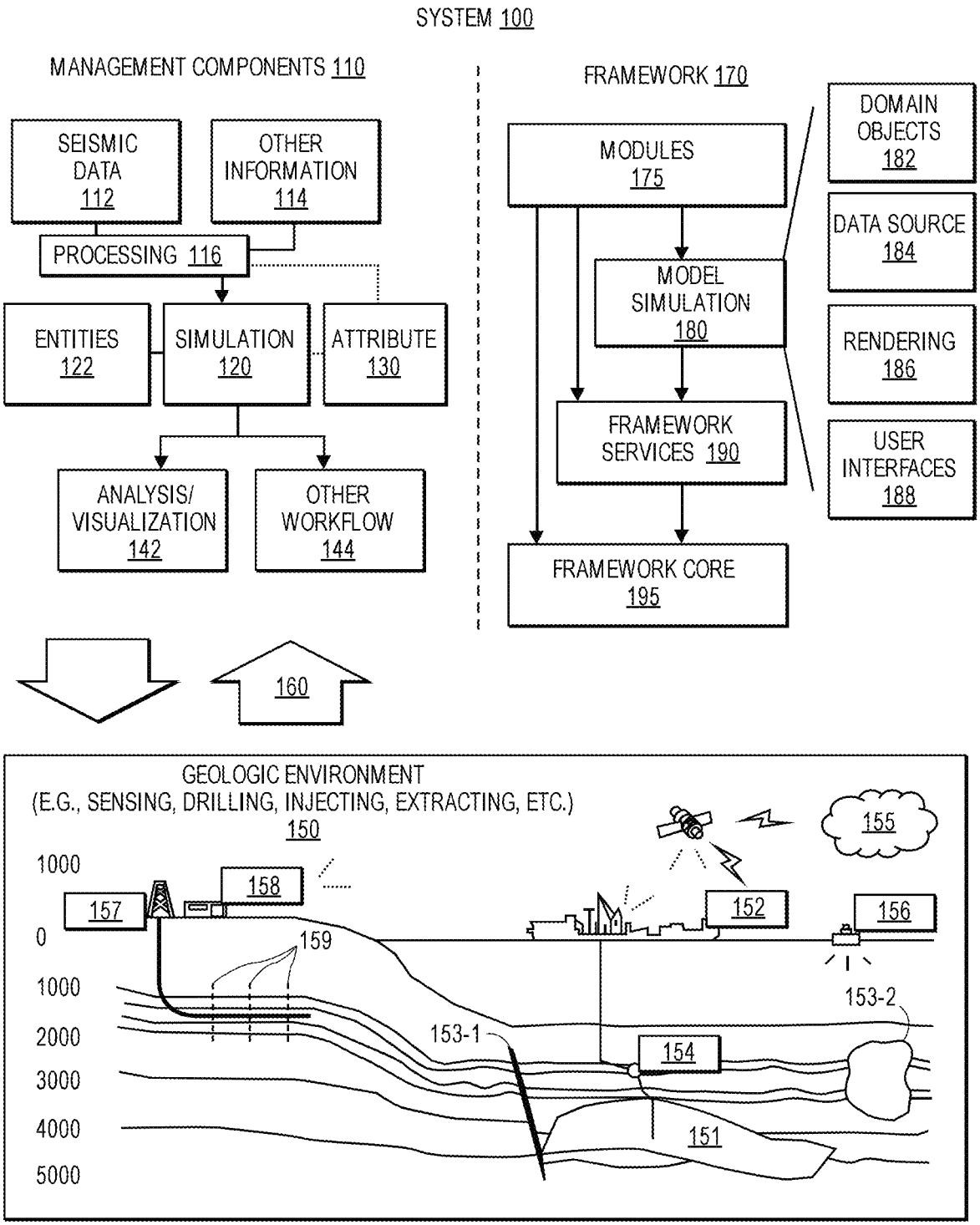
FIG. 1 illustrates an example of a system that includes various management components to manage various aspects of a geologic environment, according to an embodiment.

FIG. 1 illustrates an example of a system 100 that includes various management components 110 to manage various aspects of a geologic environment 150 (e.g., an environment that includes a sedimentary basin, a reservoir 151, one or more faults 153-1, one or more geobodies 153-2, etc.). For example, the management components 110 may allow for direct or indirect management of sensing, drilling, injecting, extracting, etc., with respect to the geologic environment 150. In turn, further information about the geologic environment 150 may become available as feedback 160 (e.g., optionally as input to one or more of the management components 110).

In the example of FIG. 1, the management components 110 include a seismic data component 112, an additional information component 114 (e.g., well/logging data), a processing component 116 (e.g., including calibration of the processing results with well data), a simulation component 120, an attribute component 130, an analysis/visualization component 142 and a workflow component 144. In operation, seismic data and other information provided per the components 112 and 114 may be input to the simulation component 120. The other information may be or include well data. The components 112, 114 may be or include well data such as well logs, drilling logs, and/or cores, which may be used to calibrate the seismic data to rock and fluid properties.

In an example embodiment, the simulation component 120 may rely on entities 122. Entities 122 may include earth entities or geological objects such as wells, well data (e.g., used for calibration of rock and fluid properties), surfaces, bodies, reservoirs, etc. In the system 100, the entities 122 can include virtual representations of actual physical entities that are reconstructed for purposes of simulation. The entities 122 may include entities based on data acquired via sensing, observation, etc. (e.g., the seismic data 112 and other information 114). An entity may be characterized by one or more properties (e.g., a geometrical pillar grid entity of an earth model may be characterized by a porosity property). Such properties may represent one or more measurements (e.g., acquired data), calculations, etc.

In an example embodiment, the simulation component 120 may operate in conjunction with a software framework such as an object-based framework. In such a framework, entities may include entities based on pre-defined classes to facilitate modeling and simulation. A commercially available example of an object-based framework is the MICROSOFT®.NET® framework (Redmond, Washington), which provides a set of extensible object classes. In the NET® framework, an object class encapsulates a module of reusable code and associated data structures. Object classes can be used to instantiate object instances for use in by a program, script, etc. For example, borehole classes may define objects for representing boreholes based on well data.

In the example of FIG. 1, the simulation component 120 may process information to conform to one or more attributes specified by the attribute component 130, which may include a library of attributes. Such processing may occur prior to input to the simulation component 120 (e.g., consider the processing component 116). As an example, the simulation component 120 may perform operations on input information based on one or more attributes specified by the attribute component 130. In an example embodiment, the simulation component 120 may construct one or more models of the geologic environment 150, which may be relied on to simulate behavior of the geologic environment 150 (e.g., responsive to one or more acts, whether natural or artificial). In the example of FIG. 1, the analysis/visualization component 142 may allow for interaction with a model or model-based results (e.g., simulation results, etc.). As an example, output from the simulation component 120 may be input to one or more other workflows, as indicated by a workflow component 144.

As an example, the simulation component 120 may include one or more features of a simulator such as the ECLIPSE™ reservoir simulator (SLB, Houston Texas), the INTERSECT™ reservoir simulator (SLB, Houston Texas), etc. As an example, a simulation component, a simulator, etc. may include features to implement one or more meshless techniques (e.g., to solve one or more equations, etc.). As an example, a reservoir or reservoirs may be simulated with respect to one or more enhanced recovery techniques (e.g., consider a thermal process such as SAGD, etc.).

In an example embodiment, the management components 110 may include features of a commercially available framework such as the PETREL® seismic to simulation software framework (SLB, Houston, Texas). The PETREL® framework provides components that allow for optimization of exploration and development operations. The PETREL® framework includes seismic to simulation software components that can output information for use in increasing reservoir performance, for example, by improving asset team productivity. Through use of such a framework, various professionals (e.g., geophysicists, geologists, and reservoir engineers) can develop collaborative workflows and integrate operations to streamline processes. Such a framework may be considered an application and may be considered a data-driven application (e.g., where data is input for purposes of modeling, simulating, etc.).

In an example embodiment, various aspects of the management components 110 may include add-ons or plug-ins that operate according to specifications of a framework environment. For example, a commercially available framework environment marketed as the OCEAN® framework environment (SLB, Houston, Texas) allows for integration of add-ons (or plug-ins) into a PETREL® framework workflow. The OCEAN® framework environment leverages .NET® tools (Microsoft Corporation, Redmond, Washington) and offers stable, user-friendly interfaces for efficient development. In an example embodiment, various components may be implemented as add-ons (or plug-ins) that conform to and operate according to specifications of a framework environment (e.g., according to application programming interface (API) specifications, etc.).

FIG. 1 also shows an example of a framework 170 that includes a model simulation layer 180 along with a framework services layer 190, a framework core layer 195 and a modules layer 175. The framework 170 may include the commercially available OCEAN® framework where the model simulation layer 180 is the commercially available PETREL® model-centric software package that hosts OCEAN® framework applications. In an example embodiment, the PETREL® software may be considered a data-driven application. The PETREL® software can include a framework for model building and visualization.

As an example, a framework may include features for implementing one or more mesh generation techniques. For example, a framework may include an input component for receipt of information from interpretation of seismic data, one or more attributes based at least in part on seismic data, log data, image data, etc. Such a framework may include a mesh generation component that processes input information, optionally in conjunction with other information, to generate a mesh.

In the example of FIG. 1, the model simulation layer 180 may provide domain objects 182, act as a data source 184, provide for rendering 186 and provide for various user interfaces 188. Rendering 186 may provide a graphical environment in which applications can display their data while the user interfaces 188 may provide a common look and feel for application user interface components.

As an example, the domain objects 182 can include entity objects, property objects and optionally other objects. Entity objects may be used to geometrically represent wells, surfaces, bodies, reservoirs, etc., while property objects may be used to provide property values as well as data versions and display parameters. For example, an entity object may represent a well where a property object provides log information as well as version information and display information (e.g., to display the well as part of a model).

In the example of FIG. 1, data may be stored in one or more data sources (or data stores, generally physical data storage devices), which may be at the same or different physical sites and accessible via one or more networks. The model simulation layer 180 may be configured to model projects. As such, a particular project may be stored where stored project information may include inputs, models, results and cases. Thus, upon completion of a modeling session, a user may store a project. At a later time, the project can be accessed and restored using the model simulation layer 180, which can recreate instances of the relevant domain objects.

In the example of FIG. 1, the geologic environment 150 may include layers (e.g., stratification) that include a reservoir 151 and one or more other features such as the fault 153-1, the geobody 153-2, etc. As an example, the geologic environment 150 may be outfitted with any of a variety of sensors, detectors, actuators, etc. For example, equipment 152 may include communication circuitry to receive and to transmit information with respect to one or more networks 155. Such information may include information associated with downhole equipment 154, which may be equipment to acquire information, to assist with resource recovery, etc. Other equipment 156 may be located remote from a well site and include sensing, detecting, emitting or other circuitry. Such equipment may include storage and communication circuitry to store and to communicate data, instructions, etc. As an example, one or more satellites may be provided for purposes of communications, data acquisition, etc. For example, FIG. 1 shows a satellite in communication with the network 155 that may be configured for communications, noting that the satellite may additionally or instead include circuitry for imagery (e.g., spatial, spectral, temporal, radiometric, etc.).

FIG. 1 also shows the geologic environment 150 as optionally including equipment 157 and 158 associated with a well that includes a substantially horizontal portion that may intersect with one or more fractures 159. For example, consider a well in a shale formation that may include natural fractures, artificial fractures (e.g., hydraulic fractures) or a combination of natural and artificial fractures. As an example, a well may be drilled for a reservoir that is laterally extensive. In such an example, lateral variations in properties, stresses, etc. may exist where an assessment of such variations may assist with planning, operations, etc. to develop a laterally extensive reservoir (e.g., via fracturing, injecting, extracting, etc.). As an example, the equipment 157 and/or 158 may include components, a system, systems, etc. for fracturing, seismic sensing, analysis of seismic data, assessment of one or more fractures, etc.

As mentioned, the system 100 may be used to perform one or more workflows. A workflow may be a process that includes a number of worksteps. A workstep may operate on data, for example, to create new data, to update existing data, etc. As an example, a workstep may operate on one or more inputs and create one or more results, for example, based on one or more algorithms. As an example, a system may include a workflow editor for creation, editing, executing, etc. of a workflow. In such an example, the workflow editor may provide for selection of one or more pre-defined worksteps, one or more customized worksteps, etc. As an example, a workflow may be a workflow implementable in the PETREL® software, for example, that operates on seismic data, seismic attribute(s), etc. As an example, a workflow may be a process implementable in the OCEAN® framework. As an example, a workflow may include one or more worksteps that access a module such as a plug-in (e.g., external executable code, etc.).

Automated Cement Quality Evaluation

The present disclosure presents a system and method for automatically evaluating and classifying the cement quality in wellbores. The method includes a set of domain-driven algorithms that simulate human logic and allow flexible adjustment of thresholds to meet varying demands. The method supports input data collected from three types of tools-Isolation Scanner Tools, Ultrasonic Transmitter Tools, and Sonic Logging Tools-which can be independently interpreted or integrated for a comprehensive evaluation. The method delivers intermediate outputs such as multiple quality control results, including calibration to raw data based on tool principles and detection of casing collar and centralizer structures, as well as the final zoned classification of cement quality in the well. With high efficiency, accuracy, and consistency, the method reduces processing time from days to seconds. As an algorithmic process, it can be deployed or used as a part in various logging software applications, contributing to interpretation work and enhancing decision-making processes at wellsite.

The present disclosure addresses the inefficiency and potential for errors in the conventional methods of evaluating the cement quality in a wellbore (e.g., between a casing and a formation), which relies on manual interpretation of large volumes of logging data by skilled professionals. The method described herein incorporates domain evaluation criteria to automatically process logging data from various downhole (e.g., sonic and/or ultrasonic tools), along with flexible user-defined thresholds. The method rapidly outputs zoned evaluations of the cement quality and provides analysis channels, (e.g., collar and centralizer structure detection and identification of connected liquid channels) within seconds.

Unlike conventional methods that are time-consuming and prone to human error, the method described herein delivers consistent and accurate evaluations in a fraction of the time (e.g., from 1-2 days to seconds). The method integrates domain-specific logic and utilizes diverse data from multiple different downhole (e.g., sonic and/or ultrasonic) logging tools to ensure comprehensive and reliable results. Additionally, the method may be hosted in the cloud, offering a seamless logging-interpretation-reporting workflow for users.

Figure 2:
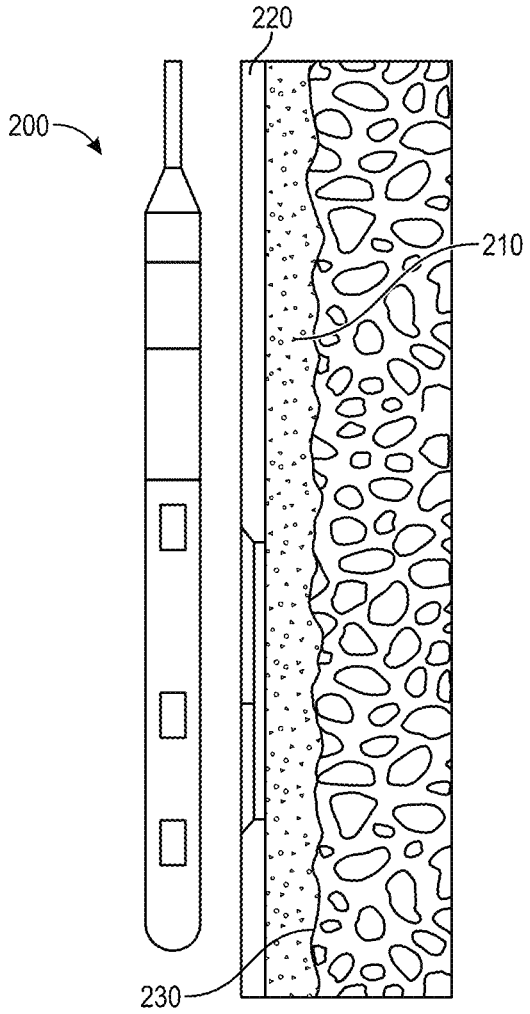
FIG. 2 illustrates a downhole (e.g., logging) tool that may capture data that is used to evaluate the quality of cement in a wellbore, according to an embodiment.

FIG. 2 illustrates a downhole (e.g., logging) tool 200 that may capture data that is used to evaluate the quality of cement 210 in a wellbore 230, according to an embodiment. The cement 210 may be positioned radially-between a casing 220 and a wall of the wellbore 230. The downhole tool 200 may be or include an acoustic logging tool, an isolation scanner (IBC) tool, a sonic and/or ultrasonic logging tool, or a combination thereof. The method described herein can process the logging data captured by the downhole tool 200, which may be based upon a solid-liquid-gas (SLG) map.

Figure 3:
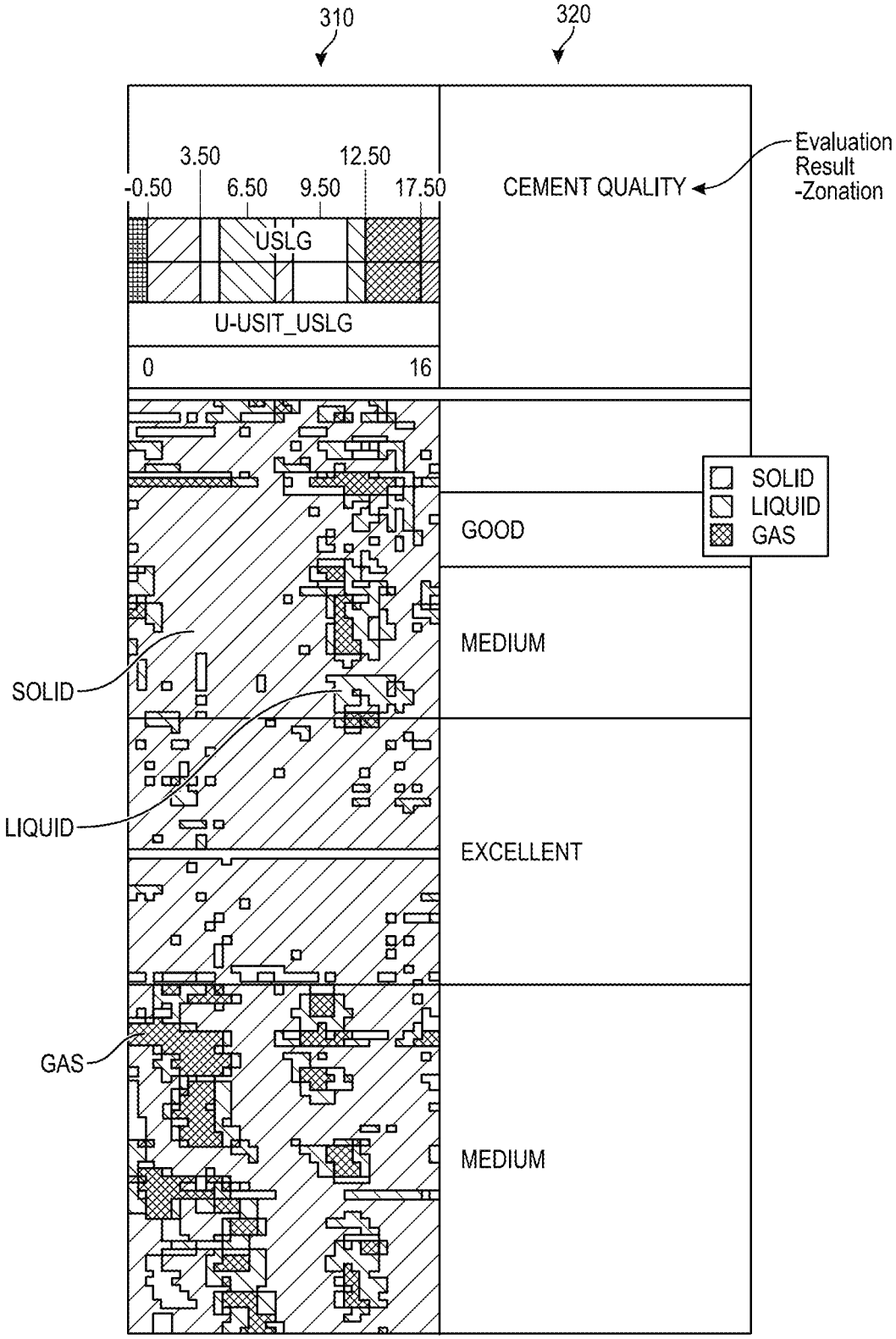
FIG. 3 illustrates the data captured by the downhole tool, according to an embodiment.

FIG. 3 illustrates the data captured by the downhole tool 200, according to an embodiment. More particularly, FIG. 3 shows the SLG map 310 displaying the material distribution behind the casing 220 and manual zonation showing different cement quality zones 320 based upon the SLG map 310. The left side of FIG. 3 shows the SLG map 310, which may serve as input data for the method. The SLG map 310 may use different hatching, shading, and/or colors to denote material compositions. The right side of FIG. 3 shows the evaluation result: zonation with different cement qualities. The method can rapidly output zone evaluations of cement quality and provide a quality control result, such as collar and centralizer structure detection and identification of connected liquid channels, within seconds.

Figure 4:
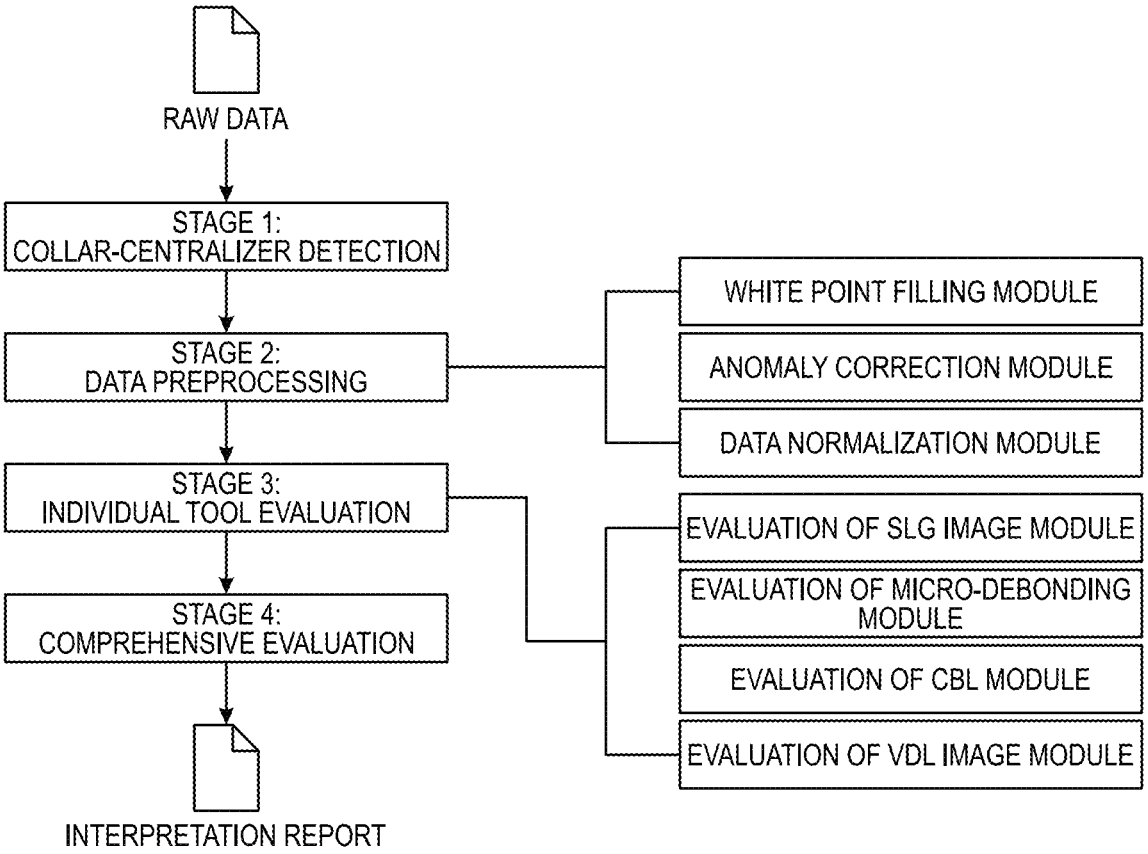
FIG. 4 illustrates a flowchart of a method for evaluating the cement quality in a wellbore, according to an embodiment.

FIG. 4 illustrates a flowchart of a method for evaluating the cement quality in a wellbore, according to an embodiment. The method may simulate human interpretation logic for cement quality zoning, dividing the well log into different quality levels. The method may also produce output quality control (i.e., QC) results along the different stages. The method may also provide multiple customizable algorithm modules to fit different application scenarios.

The method may offer consistency, accuracy, and efficiency, thereby reducing analysis time and minimizing human error. For logging tools with different physics mechanisms, the method can provide specific interpretations based on the inputs. The method provides flexibility to users so that they can customize the algorithm modules. Additionally, if the method is hosted in the cloud, it may offer a seamless logging-interpretation-reporting workflow for users.

Figure 5:
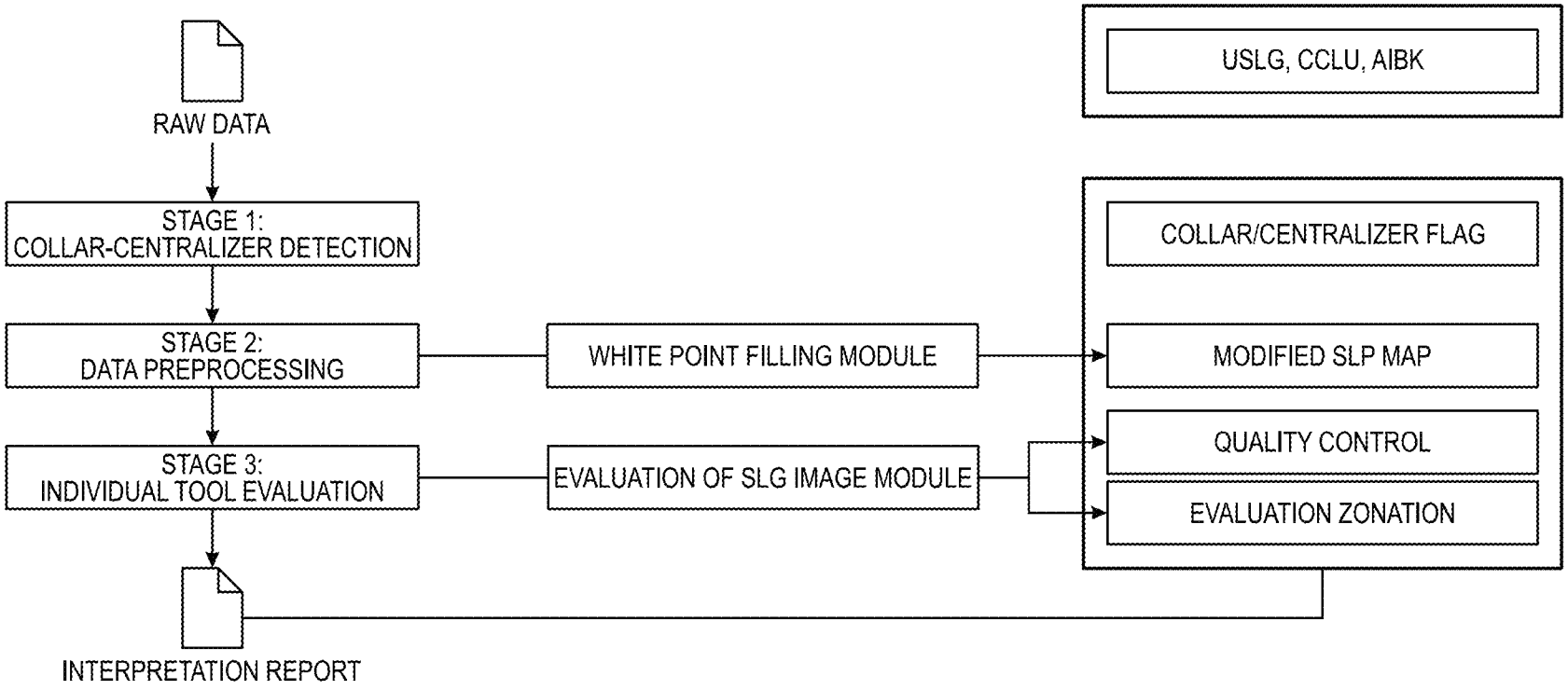
FIG. 5 illustrates a flowchart of a method for evaluating a solid-liquid-gas (SLG) map for an IBC tool, according to an embodiment.
Figure 6:
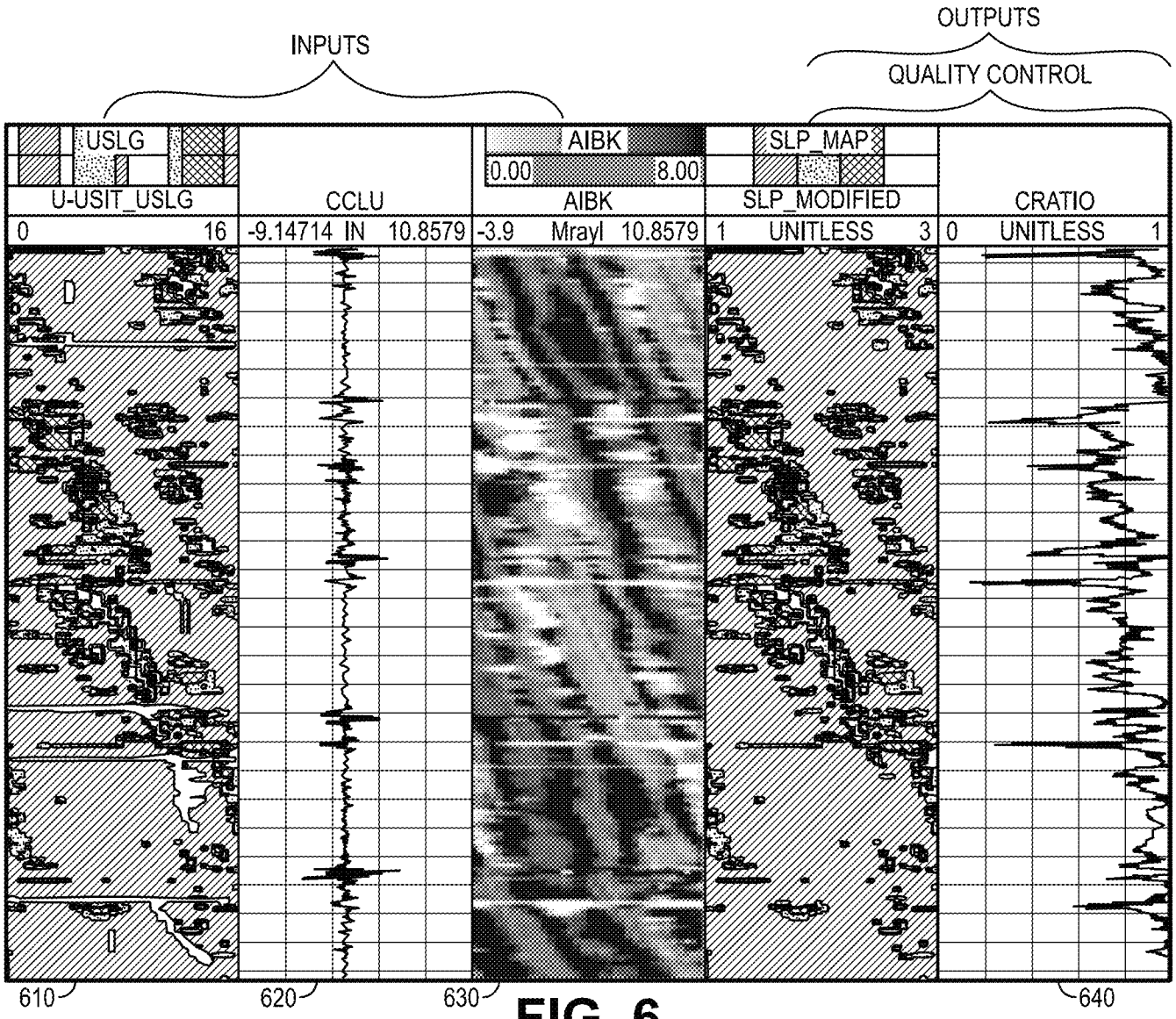
FIG. 6 illustrates inputs and outputs for the method shown in FIG. 5, according to an embodiment.
Figure 6:
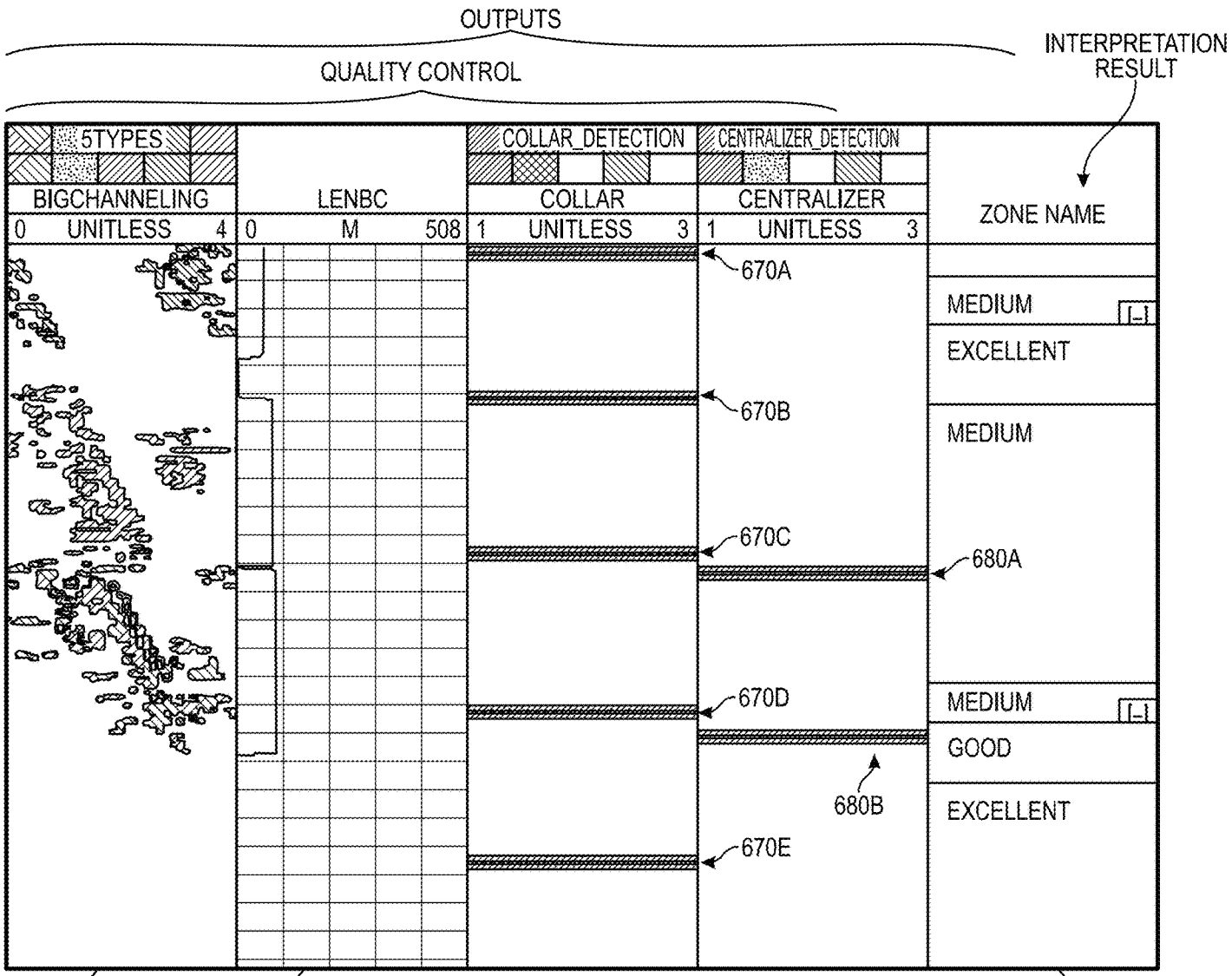

FIG. 5 illustrates a flowchart of a method for evaluating a solid-liquid-gas (SLG) map for an IBC tool, according to an embodiment. FIG. 6 illustrates inputs and outputs for the method shown in FIG. 5, according to an embodiment. The input(s) may be or include the data collected by downhole logging tool(s) 200. Depending on different logging mechanisms, the input format may vary. For example, when using an IBC tool, the input(s) of the method may include the SLG map 610, curve data obtained from casing collar locator measurements (CCLU) 620, and/or a map derived from acoustic impedance measurements (AIBK) 630 channels with customized threshold parameters. The output(s) of the method may include intermediate QC channels (e.g., modified cement filling ratio 640, channeling structure 650, maximum channeling length at each depth 660, collar position 670A-670E, and centralizer position 680A, 680B) and interpretation results as a zonation with different cement quality zones 690.

As mentioned above, the method may process large volumes of input data from various logging tools and generate a comprehensive evaluation result. It reduces the analysis time from days to seconds by automating the process. It employs a comprehensive set of built-in evaluation criteria and physical models to simulate human logic, resulting in more accurate and consistent interpretation. Additionally, it features a quality control mechanism that allows users to trace results and quickly identify and correct issues. This makes the system user-friendly, offering a one-click solution that is both efficient and reliable compared to manual methods. The method can fit any product involving cement quality evaluation. It can be integrated into desktop software (e.g., Techlog®), as a script. It can also be deployed on cloud platform as a feature.

For a user scenario that utilizes the IBC logging tool, validation tests were conducted on the automated evaluation algorithm using 12 sets of real IBC datasets from business cases, with depths ranging from 1600 meters to over 7000 meters. For each dataset, manual evaluation was performed as a benchmark. The data was then processed by the method using default parameters. The computations took less than 15 seconds. The quality levels assigned by manual evaluation were compared with those from the automated system, finding an average consistency of 88%. 11 datasets had consistency above 80%, with the highest reaching 95.71%. The one dataset with lowest consistency (72.71%) had inconsistencies in manual annotations, while the automated results remained stable. These tests demonstrate that this method enhances evaluation efficiency and maintains high accuracy.

Figure 7:
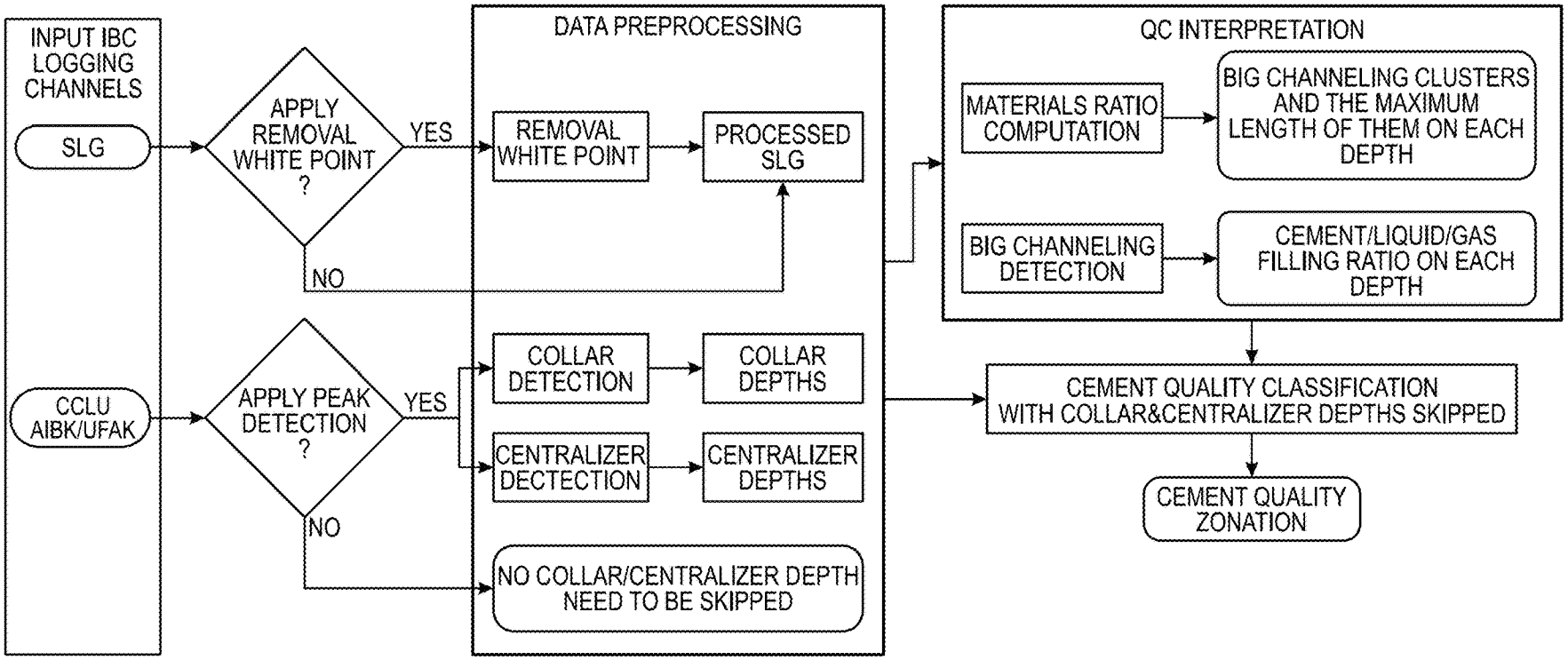
FIG. 7 illustrates a method for evaluating cement quality on a SLG map for an IBC tool, according to an embodiment.

FIG. 7 illustrates a method for evaluating cement quality on a SLG map for an IBC tool, according to an embodiment. The previously mentioned specific customizable implementation: evaluation on the SLG map for the IBC tool (refer to FIG. 5), includes the following algorithm modules: data preprocessing, quality control interpretation and cement quality classification.

The data preprocessing stage addresses the impact of non-standard conditions in a raw SLG map on quality evaluation. By removing white points and identifying the depths of collars and centralizer structures, the method prepares the data for accurate evaluation, minimizing interference and ensuring the reliability of subsequent stages. The QC interpretation uses built-in criteria to generate multiple indicators for solid, liquid, and gas (e.g., the shape of big channelings for liquid). This step outputs individual indicators for manual judgement logic and prepares them for comprehensive quality classification. Finally, based on the previous steps, the method generates a zonation with different cement quality levels.

The method represents the first automated cement quality evaluation workflow. For example, white point filling for raw data and individual quality assessment of data collected by multiple tools are new. Moreover, the comprehensive processing of evaluation results from multiple tools, including both sonic and ultrasonic tools, has not been done before.

Collar-Centralizer Detection

Figure 8:
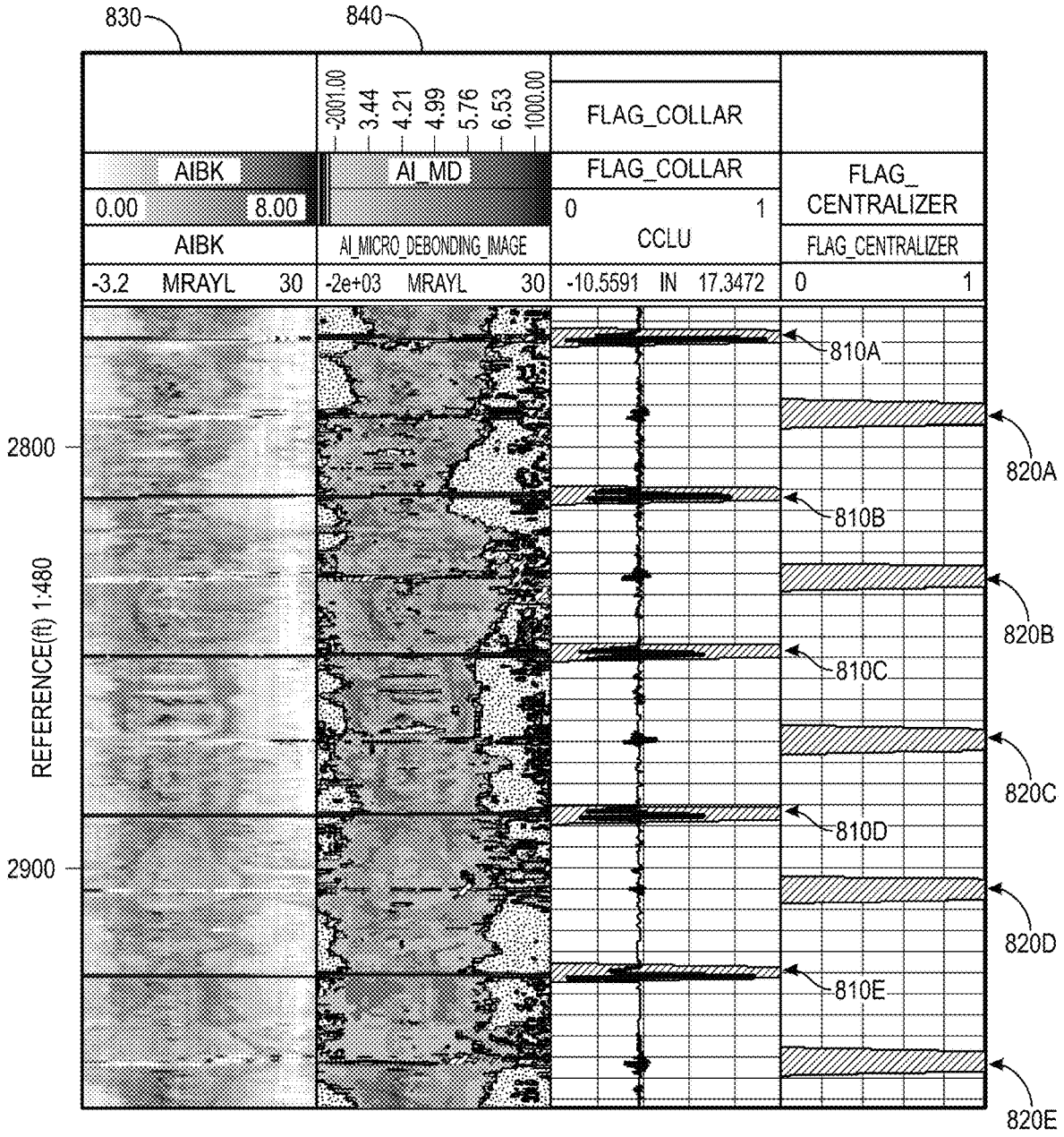
FIG. 8 illustrates collar-centralizer detection results visualization, according to an embodiment.

FIG. 8 illustrates collar-centralizer detection results visualization, according to an embodiment. The collars 810A-810E are internal casing components designed to prevent the cement 210 from flowing back into the casing 220. The centralizers 820A-820E are external devices that keep the casing 220 centered within the wellbore 230. For example, input images for evaluation may exhibit abnormal lines in these two structures (see FIG. 8). Without proper identification, these may be misinterpreted as poor cement quality, whereas they should be ignored in the evaluation. To address this, the method introduces a collar and centralizer detection module. This involves establishing a physical model to identify the depth locations of these structures and their correlation with peaks in an AIBK channel 830 and a CCLU channel 840. By using signal peak detection, the method can accurately determine and output the depths of these components.

Data Preprocessing

Figures 9A, 9B:
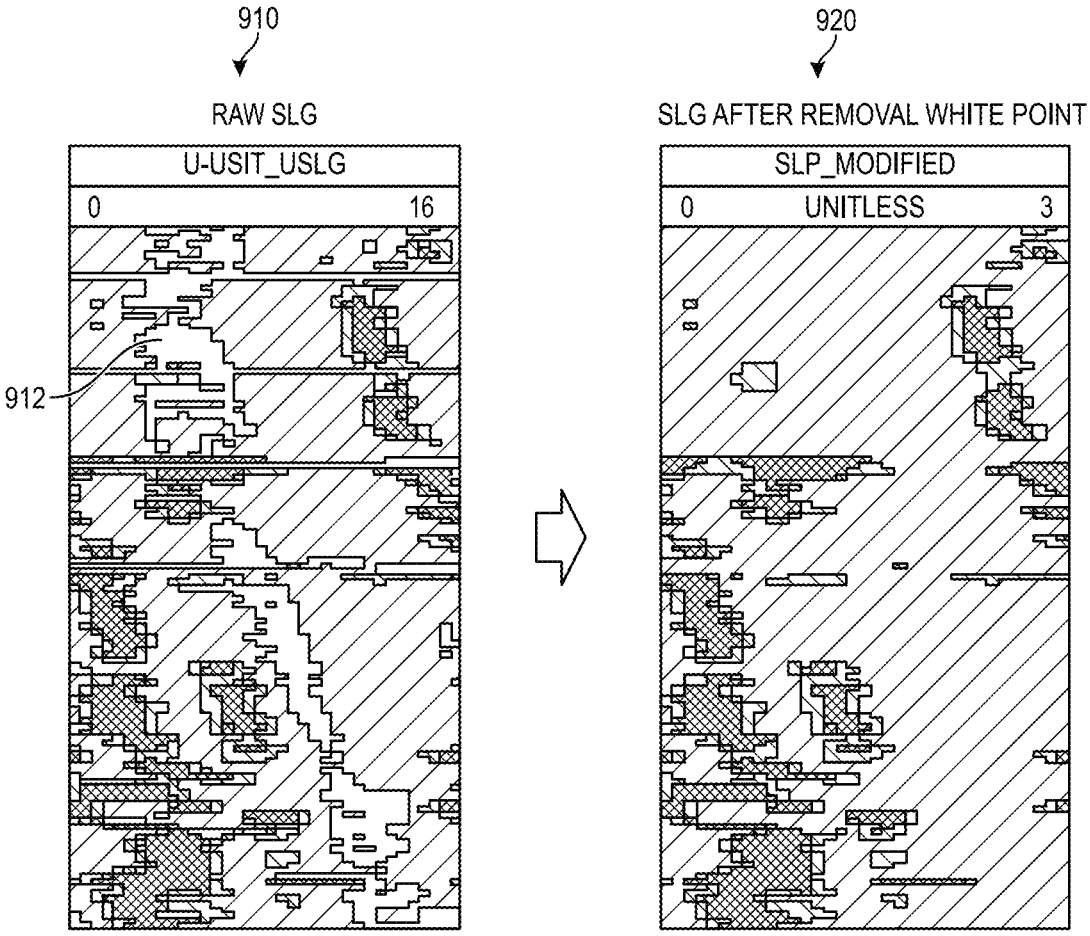
FIG. 9A illustrates an input raw SLG map.
FIG. 9B illustrates an output modified SLG map (e.g., after white point filling), according to an embodiment.

FIG. 9A illustrates an input raw SLG map 910, and FIG. 9B illustrates an output modified SLG map 920 (e.g., after white point filling), according to an embodiment. In this stage, the method uses several modules to address different issues. The white points 912 in FIG. 9A represent uncertain information in image data, potentially causing misinterpretations if the raw data is used directly. To address this, the method introduces a "white point filling" module that predicts the actual material at white point locations and fills in the image. The method uses a clustering approach to label adjacent white points and then color, shade, or hatch each cluster from the outside in. The predicted color, shade, or hatch for each point may be based on the most frequently occurring non-white color, shade, or hatch in the surrounding area, effectively replacing the white points with surrounding actual data and reducing the likelihood of misjudgment.

In conjunction with the collar-centralizer detection, the method offers anomaly correction processing. This module supports global white spot filling in image data and/or local white point filling at specific locations (e.g., collars). For some raw data, the method may include a normalization module (e.g., to calibrate and smooth the cement bond log (CBL) curve).

Individual Evaluation

Figure 11:
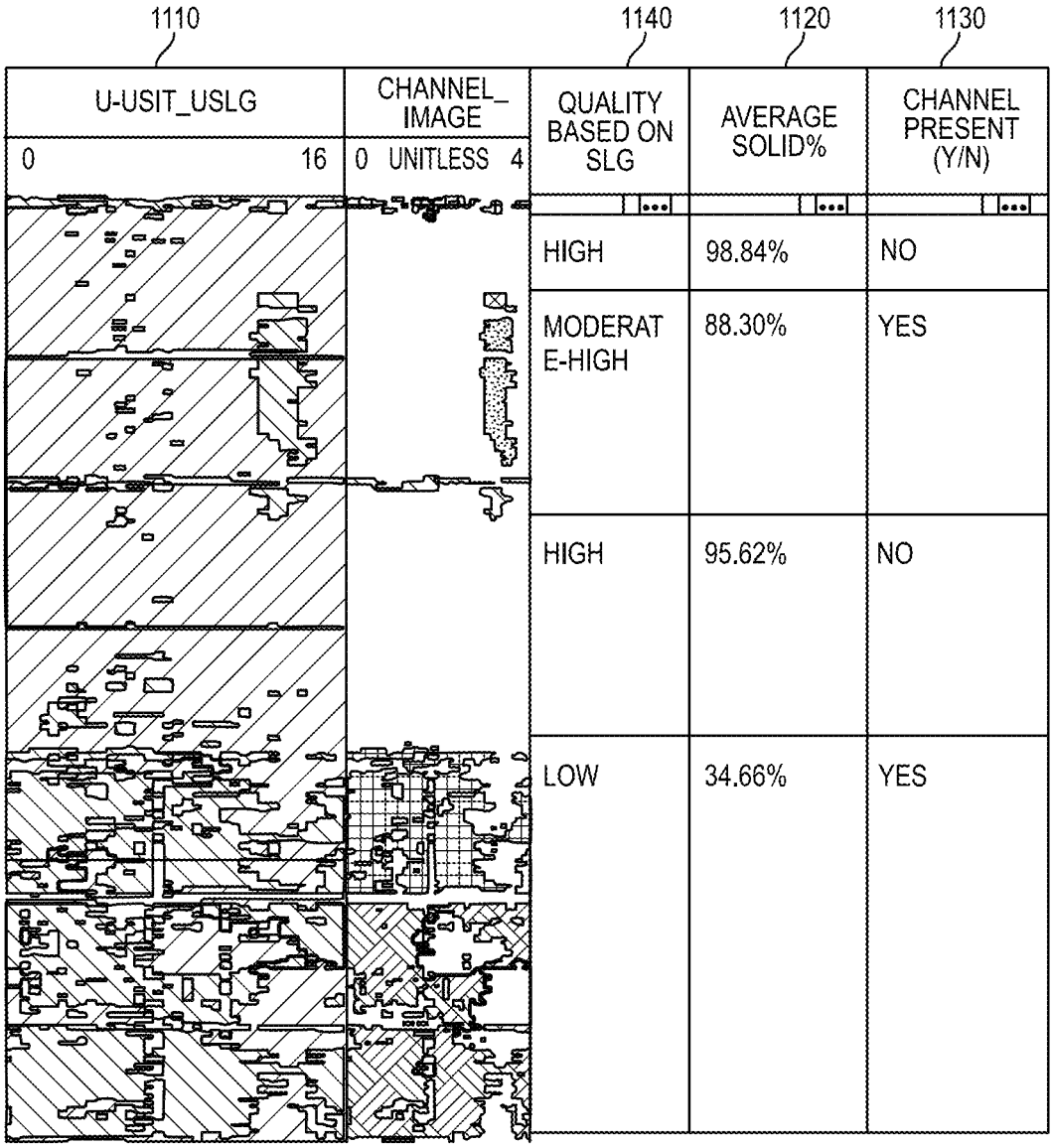
FIG. 11 illustrates an example QC and evaluation result (e.g., based on an SLG map), according to an embodiment.

FIG. 10 illustrates a table showing built-in cement quality evaluation criteria (e.g., based on an SLG map and CBL), according to an embodiment. FIG. 11 illustrates an example QC and evaluation result (e.g., based on an SLG map 1110), according to an embodiment. This stage supports the individual evaluation of data collected from various sonic and ultrasonic tools. To enhance the credibility and accuracy of the evaluation results, the method uses an internal QC interpretation module. This module follows (e.g., manual) judgment logic and selects different evaluation criteria based on the focus of different logging tools.

For example, the IBC tool algorithm emphasizes SLG map features, including the solid content ratio at each depth 1120 and whether liquids and gases form large, connected channels 1130. On the other hand, the sonic tool focuses on features of the CBL curve and VDL images (see FIG. 10).

The module outputs results related to these feature indicators separately (see FIG. 11), serving as the basis for the final classification quality algorithm and as a cross-checking tool for users. If users have doubts about the results, they can trace back to the QC results to identify issues with specific indicator thresholds. This allows them to modify input parameters and quickly conduct the next automated evaluation, thereby reducing repetitive workload.

Figure 12B:
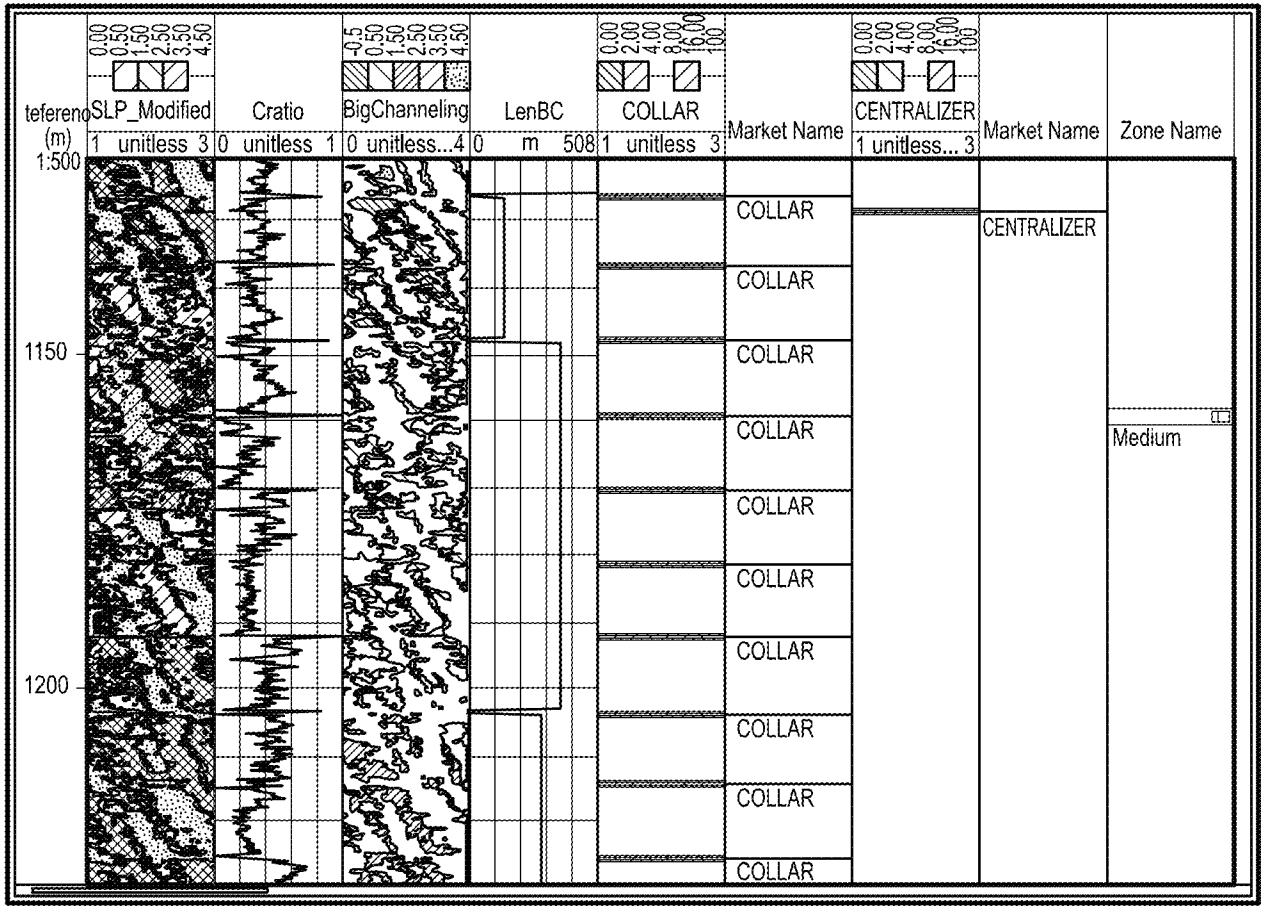

The method allows developers to select suitable algorithm modules based on specific application scenarios and deploy them into any application (e.g., scripts, apps, etc.) to support automated cement quality evaluation. FIGS. 12A and 12B illustrate an application interface of Techlog®, according to an embodiment. The workflow of automated cement evaluation for SLG on Techlog® is:

(1) Download Python® scripts of automated algorithm in Techlog® project folder, and import required Python® libraries in Techlog®.

(2) Open the algorithm entrance script from AWI, and select IBC data to evaluate.

(3) Input customized parameters in AWI. Click the start button.

(4) Obtain QC interpretation channels and evaluation result zonation in data explorer. Apply template for outputs. Optionally loop back and repeat step (3).

Figure 13:
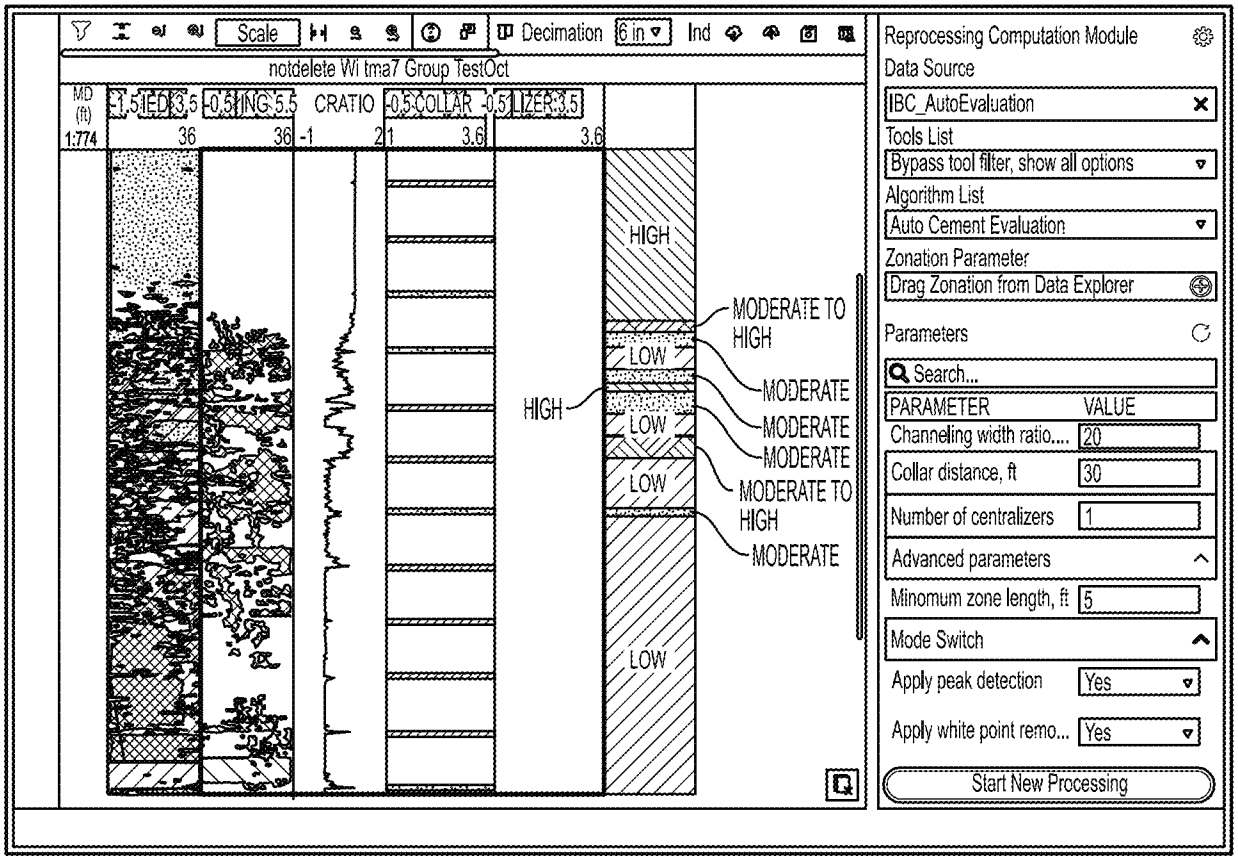
FIG. 13 illustrates an application interface of a cloud product application of WBI-WI, according to an embodiment.

FIG. 13 illustrates an application interface of a cloud product application of WBI-WI, according to an embodiment. The workflow of automated cement evaluation for SLG on WBI-WI is:

(1) Login to WBI-WI, open the reprocessing computation module, select IBC data to evaluate and auto cement evaluation algorithm.

(2) Input customized parameters. Click start new reprocessing.

(3) Obtain QC interpretation channels and evaluation result zonation in data explorer. Apply template for outputs. Optionally loop back and repeat step (3).

Exemplary Method

Figure 14:
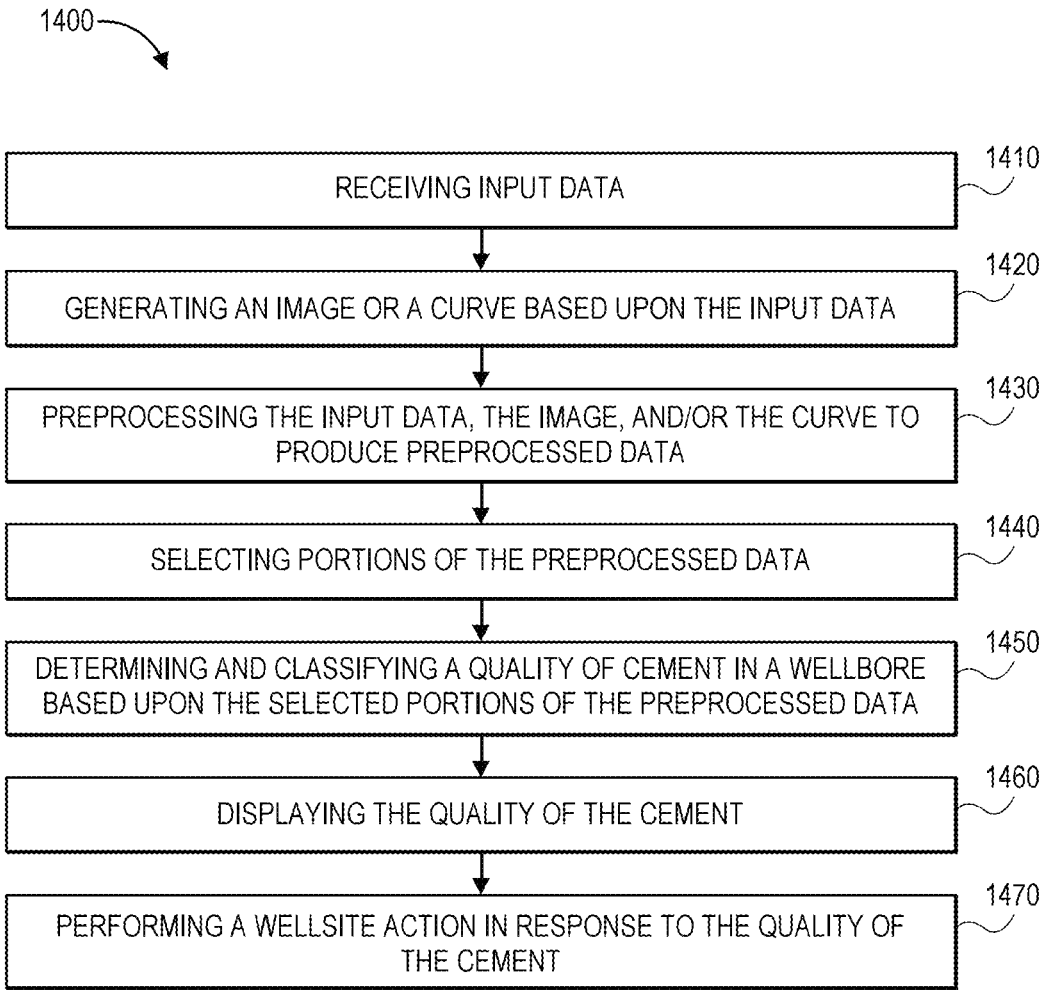
FIG. 14 illustrates a flowchart of a method for evaluating a quality of cement in a wellbore 230, according to an embodiment.

FIG. 14 illustrates a flowchart of a method 1400 for evaluating a quality of cement 210 in a wellbore 230, according to an embodiment. The cement 210 may be in an annulus between a tubular member (e.g., liner or casing) 220 and a formation (e.g., the wall of the wellbore) 230. An illustrative order of the method 1400 is provided below; however, one or more portions of the method 1400 may be performed in a different order, simultaneously, repeated, or omitted. At least a portion of the method 1400 may be performed with a computing system (described below).

The method 1400 may include receiving input data, as at 1410. The input data may be captured by one or more logging tools 200 in the wellbore 230. The one or more logging tools 200 may be or include one or more acoustic logging tools. The one or more acoustic logging tools may be or include a sonic logging tool and/or an ultrasonic logging tool. The ultrasonic logging tool may be or include an isolation scanner tool and/or an ultrasonic transmitter tool. The input data may include a plurality of measurements such as (1) acoustic impedance measurements, (2) flexural attenuation measurements, (3) sonic wave amplitude measurements (e.g., that are part of a cement bond log), (4) casing collar locator measurements 620, or a combination thereof.

The method 1400 may also include generating an image or a curve based upon the input data, as at 1420. The image may be a solid-liquid-gas (SLG) image 310, 610, 910 that is based upon the acoustic impedance measurements and/or the flexural attenuation measurements. The image may also or instead be a micro-debonding image that is based upon the acoustic impedance measurements. The curve may be a bond index (BI) curve that is based upon the sonic wave amplitude measurements.

The method 1400 may also include preprocessing the input data, the image, and/or the curve to produce preprocessed data, as at 1430. The preprocessed data may be or include a modified SLG image 920, a modified micro-debonding image, and/or a modified BI curve.

In one embodiment, preprocessing may include detecting positions of one or more casing collars 670A-670E, 810A-810E and/or one or more centralizers 680A-680B, 820A-820E in the wellbore 230. The positions may be detected based upon the acoustic impedance measurements and/or the casing collar locator measurements 620. Preprocessing may also include identifying anomalous data in the input data and/or the image based upon the positions of the one or more casing collars 670A-670E, 810A-810E and the one or more centralizers 680A-680B, 820A-820E. The anomalous data represents materials that cannot be identified with a predetermined confidence level (e.g., caused by defects of the one or more acoustic logging tools 200 and/or wellbore conditions). The anomalous data may be identified in the SLG image 310, 610, 910 and/or the micro-debonding image. Preprocessing may also include calibrating portions of the input data and/or the image that include or represent the one or more casing collars 810A-810E, the one or more centralizers 680A-680B, 820A-820E, and/or the anomalous data to produce the modified SLG image 920 and/or the modified micro-debonding image. This may reduce an influence of the one or more casing collars 670A-670E, 810A-810E, the one or more centralizers 680A-680B, 820A-820E, and/or the anomalous data that are, thereby representing a more accurate condition of the wellbore 230.

In another embodiment, preprocessing may also or instead include calibrating the sonic wave amplitude measurements and producing the modified BI curve based on the calibrated sonic wave amplitude measurements. This serves as an indicator for evaluating the cement quality based on sonic logging.

The method 1400 may also include selecting portions of the preprocessed data for determining and classifying the quality of the cement in the wellbore, as at 1440. The selected portions may include the modified SLG image 920 in response to at least a portion of the input data being captured by the isolation scanner tool. The selected portions may also or instead include the modified micro-debonding image in response to at least a portion of the input data being captured by the ultrasonic transmitter tool. The selected portions may also or instead include the modified BI curve in response to at least a portion of the input data being captured by the sonic logging tool.

The method 1400 may also include determining and classifying the quality of the cement 210 in the wellbore 230 based upon the selected portions of the preprocessed data, as at 1450. In an embodiment, determining and classifying may include dividing the selected portions of the preprocessed data into intervals that correspond to intervals in the wellbore 230. Determining and classifying may also include identifying connected liquid and/or gas channels 1130 in the intervals in the preprocessed data. Determining and classifying may also include determining average solid, liquid, and gas composition proportions 1120 in the intervals in the preprocessed data. In another embodiment, determining and classifying may also or instead include determining an average bond index in the intervals in the preprocessed data. Determining and classifying may also include classifying the intervals in the preprocessed data with different grades 690, 1140 based upon the connected liquid and/or gas channels 1130, the average solid, liquid, and gas composition proportions 1120, and/or the average bond index. In an example, the grades may include low, moderate, moderate-to-high, and/or high.

The method 1400 may also include displaying the quality of the cement, as at 1460. The intervals, the connected liquid and/or gas channels 1130, the average solid, liquid, and gas composition proportions 1120, the average bond index, and/or the grades 690, 1140 may also be displayed.

The method 1400 may also include performing a wellsite action in response to the quality of the cement, as at 1470. The wellsite action may be or include generating and/or transmitting a signal (e.g., using a computing system) that recommends, instructs, or causes a physical action to occur at a wellsite. The wellsite action may also or instead include performing the physical action at the wellsite. In one example, the physical action may be repairing the cement 210 (e.g., in response to the quality being below a predetermined threshold). The cement may be repaired by pumping additional cement into the wellbore 230 to fill the connected liquid and/or gas channels 1130.

Exemplary Computing System

Figure 15:
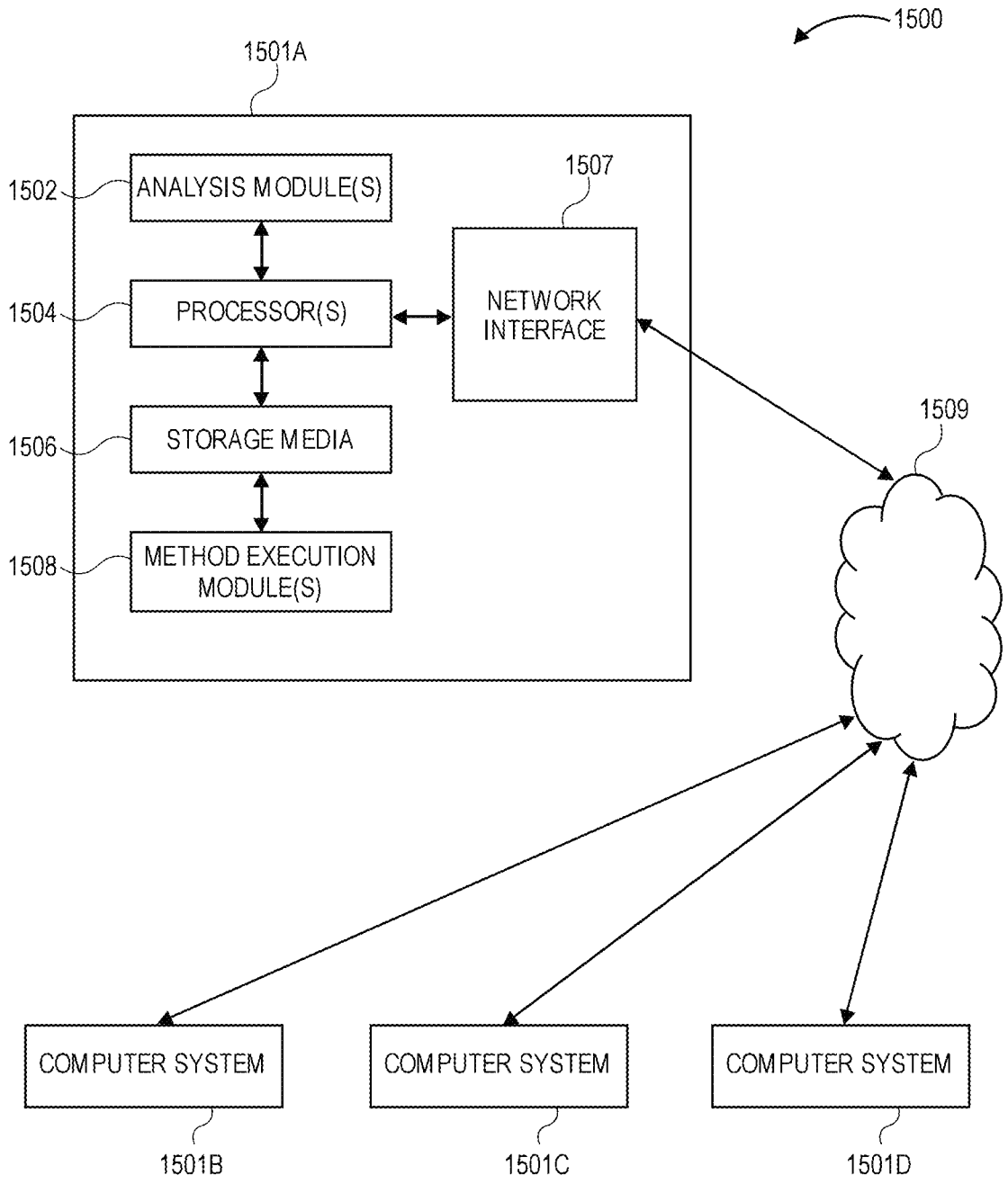
FIG. 15 illustrates a schematic view of a computing system for performing at least a portion of the method(s) described herein, according to an embodiment.

In some embodiments, the methods of the present disclosure may be executed by a computing system. FIG. 15 illustrates an example of such a computing system 1500, in accordance with some embodiments. The computing system 1500 may include a computer or computer system 1501A, which may be an individual computer system 1501A or an arrangement of distributed computer systems. The computer system 1501A includes one or more analysis modules 1502 that are configured to perform various tasks according to some embodiments, such as one or more methods disclosed herein. To perform these various tasks, the analysis module 1502 executes independently, or in coordination with, one or more processors 1504, which is (or are) connected to one or more storage media 1506. The processor(s) 1504 is (or are) also connected to a network interface 1507 to allow the computer system 1501A to communicate over a data network 1509 with one or more additional computer systems and/or computing systems, such as 1501B, 1501C, and/or 1501D (note that computer systems 1501B, 1501C and/or 1501D may or may not share the same architecture as computer system 1501A, and may be located in different physical locations, e.g., computer systems 1501A and 1501B may be located in a processing facility, while in communication with one or more computer systems such as 1501C and/or 1501D that are located in one or more data centers, and/or located in varying countries on different continents).

A processor may include a microprocessor, microcontroller, processor module or subsystem, programmable integrated circuit, programmable gate array, or another control or computing device.

The storage media 1506 may be implemented as one or more computer-readable or machine-readable storage media. Note that while in the example embodiment of FIG. 15 storage media 1506 is depicted as within computer system 1501A, in some embodiments, storage media 1506 may be distributed within and/or across multiple internal and/or external enclosures of computing system 1501A and/or additional computing systems. Storage media 1506 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 1500 contains one or more method execution module(s) 1508. In the example of computing system 1500, computer system 1501A includes the method execution module 1508. In some embodiments, a single method execution module may be used to perform some aspects of one or more embodiments of the methods disclosed herein. In other embodiments, a plurality of method execution modules may be used to perform some aspects of methods herein.

It should be appreciated that computing system 1500 is merely one example of a computing system, and that computing system 1500 may have more or fewer components than shown, may combine additional components not depicted in the example embodiment of FIG. 15, and/or computing system 1500 may have a different configuration or arrangement of the components depicted in FIG. 15. The various components shown in FIG. 15 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAS, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device (e.g., computing system 1500, FIG. 15), and/or through manual control by a user who may make determinations regarding whether a given step, action, template, model, or set of curves has become sufficiently accurate for the evaluation of the subsurface three-dimensional geologic formation under consideration.

The foregoing description, for purposes of explanation, has been described with reference to specific embodiments. However, the illustrative discussions above are not intended to be exhaustive or limiting to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principles of the disclosure and its practical applications, to thereby enable others skilled in the art to best utilize the disclosed embodiments and various embodiments with various modifications as are suited to the particular use contemplated.

What is claimed is:

1. A method for determining and classifying a quality of cement in a wellbore, the method comprising:

receiving input data, wherein the input data is captured by one or more acoustic logging tools in the wellbore, and wherein the input data comprises a plurality of measurements including acoustic impedance measurements, flexural attenuation measurements, sonic wave amplitude measurements, casing collar locator measurements, or a combination thereof;

generating an image or a curve based upon the input data;

preprocessing the input data and the image or the curve to produce preprocessed data;

selecting portions of the preprocessed data for determining and classifying the quality of the cement in the wellbore; and determining and classifying the quality of the cement in the wellbore based upon the selected portions of the preprocessed data, wherein:

the image or the curve comprises a solid-liquid-gas (SLG) image that is based upon the acoustic impedance measurements and/or the flexural attenuation measurements, and the preprocessed data comprises a modified SLG image;

the image or the curve comprises a micro-debonding image that is based upon the acoustic impedance measurements, and the preprocessed data comprises a modified micro-debonding image; or the image or the curve comprises a bond index (BI) curve that is based upon the sonic wave amplitude measurements, and the preprocessed data comprises a modified BI curve.

2. The method of claim 1, wherein the image or the curve comprises the solid-liquid-gas (SLG) image that is based upon the acoustic impedance measurements and/or the flexural attenuation measurements, and wherein the preprocessed data comprises the modified SLG image.

3. The method of claim 2, wherein the one or more acoustic logging tools comprises an ultrasonic logging tool, wherein the ultrasonic logging tool comprises an isolation scanner tool, and wherein the selected portions comprise the modified SLG image in response to at least a portion of the input data being captured by the isolation scanner tool.

4. The method of claim 1, wherein the image or the curve comprises the micro-debonding image that is based upon the acoustic impedance measurements, and wherein the preprocessed data comprises the modified micro-debonding image.

5. The method of claim 4, wherein the one or more acoustic logging tools comprises an ultrasonic logging tool, wherein the ultrasonic logging tool comprises an ultrasonic transmitter tool, and wherein the selected portions comprise the modified micro-debonding image in response to at least a portion of the input data being captured by the ultrasonic transmitter tool.

6. The method of claim 1, wherein the image or the curve comprises the bond index (BI) curve that is based upon the sonic wave amplitude measurements, and wherein the preprocessed data comprises the modified BI curve.

7. The method of claim 6, wherein the one or more acoustic logging tools comprises a sonic logging tool, and wherein the selected portions comprise the modified BI curve in response to at least a portion of the input data being captured by the sonic logging tool.

8. The method of claim 1, further comprising displaying the quality of the cement.

9. The method of claim 1, further comprising performing a wellsite action in response to the quality of the cement being below a predetermined threshold.

10. A computing system, comprising:

one or more processors; and a memory system comprising one or more non-transitory computer-readable media storing instructions that, when executed by at least one of the one or more processors, cause the computing system to perform operations, the operations comprising:

receiving input data, wherein the input data is captured by one or more logging tools in a wellbore, wherein the one or more logging tools comprise one or more acoustic logging tools, wherein the one or more acoustic logging tools comprises a sonic logging tool and/or an ultrasonic logging tool, wherein the ultrasonic logging tool comprises an isolation scanner tool and/or an ultrasonic transmitter tool, and wherein the input data comprises a plurality of measurements including:

acoustic impedance measurements;

flexural attenuation measurements;

sonic wave amplitude measurements that are part of a cement bond log;

and/or casing collar locator measurements;

generating an image or a curve based upon the input data, wherein the image or the curve comprises:

a solid-liquid-gas (SLG) image that is based upon the acoustic impedance measurements and/or the flexural attenuation measurements;

a micro-debonding image that is based upon the acoustic impedance measurements; and/or a bond index (BI) curve that is based upon the sonic wave amplitude measurements;

preprocessing the input data and the image or the curve to produce preprocessed data, wherein the preprocessed data comprises a modified SLG image, a modified micro-debonding image, and/or a modified BI curve;

selecting portions of the preprocessed data for determining and classifying a quality of cement in the wellbore, wherein the selected portions comprise:

the modified SLG image in response to at least a portion of the input data being captured by the isolation scanner tool;

the modified micro-debonding image in response to at least a portion of the input data being captured by the ultrasonic transmitter tool; and/or the modified BI curve in response to at least a portion of the input data being captured by the sonic logging tool; and determining and classifying the quality of the cement in the wellbore based upon the selected portions of the preprocessed data.

11. The computing system of claim 10, wherein preprocessing comprises detecting positions of one or more casing collars and/or one or more centralizers in the wellbore, and wherein the positions are detected based upon the acoustic impedance measurements and/or the casing collar locator measurements.

12. The computing system of claim 11, wherein preprocessing also comprises identifying anomalous data in the input data and/or the image based upon the positions of the one or more casing collars and the one or more centralizers, wherein the anomalous data represents materials that cannot be identified with a predetermined confidence level caused by defects of the one or more acoustic logging tools and/or wellbore conditions, and wherein the anomalous data is identified in the SLG image and/or the micro-debonding image.

13. The computing system of claim 12, wherein preprocessing also comprises calibrating portions of the input data and/or the image that include or represent the one or more casing collars, the one or more centralizers, and/or the anomalous data to produce the modified SLG image and/or the modified micro-debonding image, which reduces an influence of the one or more casing collars, the one or more centralizers, and/or the anomalous data that are, thereby representing a more accurate condition of the wellbore.

14. The computing system of claim 10, wherein preprocessing comprises calibrating the sonic wave amplitude measurements and producing the modified BI curve based on the calibrated sonic wave amplitude measurements, which serves as an indicator for evaluating the quality of the cement based on sonic logging.

15. A non-transitory computer-readable medium storing instructions that, when executed by one or more processors of a computing system, cause the computing system to perform operations, the operations comprising:

receiving input data, wherein the input data is captured by one or more logging tools in a wellbore, wherein the one or more logging tools comprise one or more acoustic logging tools, wherein the one or more acoustic logging tools comprises a sonic logging tool and/or an ultrasonic logging tool, wherein the ultrasonic logging tool comprises an isolation scanner tool and/or an ultrasonic transmitter tool, and wherein the input data comprises a plurality of measurements including:

acoustic impedance measurements;

flexural attenuation measurements;

sonic wave amplitude measurements that are part of a cement bond log; and casing collar locator measurements;

generating an image or a curve based upon the input data, wherein the image or the curve comprises:

a solid-liquid-gas (SLG) image that is based upon the acoustic impedance measurements and/or the flexural attenuation measurements;

a micro-debonding image that is based upon the acoustic impedance measurements; and/or a bond index (BI) curve that is based upon the sonic wave amplitude measurements;

preprocessing the input data and the image or the curve to produce preprocessed data, wherein the preprocessed data comprises a modified SLG image, a modified micro-debonding image, and/or a modified BI curve, and wherein preprocessing comprises:

detecting positions of one or more casing collars and/or one or more centralizers in the wellbore, wherein the positions are detected based upon the acoustic impedance measurements and/or the casing collar locator measurements;

identifying anomalous data in the input data and/or the image based upon the positions of the one or more casing collars and the one or more centralizers, wherein the anomalous data represents materials that cannot be identified with a predetermined confidence level caused by defects of the one or more acoustic logging tools and/or wellbore conditions, and wherein the anomalous data is identified in the SLG image and/or the micro-debonding image; and calibrating portions of the input data and/or the image that include or represent the one or more casing collars, the one or more centralizers, and/or the anomalous data to produce the modified SLG image and/or the modified micro-debonding image, which reduces an influence of the one or more casing collars, the one or more centralizers, and/or the anomalous data that are, thereby representing a more accurate condition of the wellbore; or calibrating the sonic wave amplitude measurements and producing the modified BI curve based on the calibrated sonic wave amplitude measurements, which serves as an indicator for evaluating a quality of cement based on sonic logging;

selecting portions of the preprocessed data for determining and classifying the quality of the cement in the wellbore, wherein the selected portions comprise:

the modified SLG image in response to at least a portion of the input data being captured by the isolation scanner tool;

the modified micro-debonding image in response to at least a portion of the input data being captured by the ultrasonic transmitter tool; and/or the modified BI curve in response to at least a portion of the input data being captured by the sonic logging tool; and determining and classifying the quality of the cement in the wellbore based upon the selected portions of the preprocessed data;

displaying the quality of the cement; and performing a wellsite action in response to the quality being below a predetermined threshold, wherein the wellsite action comprises generating and/or transmitting a signal that recommends, instructs, or causes a physical action to occur in or to the wellbore, and wherein the physical action comprises pumping additional cement into the wellbore to fill connected liquid and/or gas channels.

16. The non-transitory computer-readable medium of claim 15, wherein determining and classifying comprises dividing the selected portions of the preprocessed data into intervals that correspond to intervals in the wellbore.

17. The non-transitory computer-readable medium of claim 16, wherein determining and classifying further comprises:

identifying the connected liquid and/or gas channels in the intervals in the preprocessed data; and classifying the intervals in the preprocessed data with different grades based upon the connected liquid and/or gas channels.

18. The non-transitory computer-readable medium of claim 16, wherein determining and classifying further comprises:

determining average solid, liquid, and gas composition proportions in the intervals in the preprocessed data; and classifying the intervals in the preprocessed data with different grades based upon the average solid, liquid, and gas composition proportions.

19. The non-transitory computer-readable medium of claim 16, wherein determining and classifying comprises:

determining an average bond index in the intervals in the preprocessed data; and classifying the intervals in the preprocessed data with different grades based upon the average bond index.

* * * * *